US010260830B2

(12) United States Patent
Hafen

(10) Patent No.: US 10,260,830 B2
(45) Date of Patent: Apr. 16, 2019

(54) SMART-GUN SYSTEMS AND METHODS

(71) Applicant: John Hafen, Woodinville, WA (US)

(72) Inventor: John Hafen, Woodinville, WA (US)

( * ) Notice: Subject to any disclaimer, the term of this patent is extended or adjusted under 35 U.S.C. 154(b) by 52 days.

(21) Appl. No.: 15/430,354

(22) Filed: Feb. 10, 2017

(65) Prior Publication Data

US 2017/0234636 A1 Aug. 17, 2017

Related U.S. Application Data

(60) Provisional application No. 62/294,171, filed on Feb. 11, 2016.

(51) Int. Cl.
*F41A 17/64* (2006.01)
*F41A 17/06* (2006.01)

(52) U.S. Cl.
CPC ..... *F41A 17/063* (2013.01); *F41A 17/64* (2013.01)

(58) Field of Classification Search
USPC ..... 42/70.01, 70.11, 70.08, 70.06
See application file for complete search history.

(56) References Cited

U.S. PATENT DOCUMENTS 5,448,847 A 9/1995 Teetzel
5,570,528 A 11/1996 Teetzel
6,735,897 B1 * 5/2004 Schmitter ..... F41A 17/063 42/70.01
9,189,155 B2 11/2015 Kushler et al.
9,222,740 B1 12/2015 Milde, Jr. et al.
2003/0229499 A1 12/2003 Von Bosse et al.
2014/0215883 A1 8/2014 Milde, Jr. et al.
2014/0250753 A1 9/2014 Karmanov Kotliarov et al.
2014/0259841 A1 9/2014 Carlson
2014/0290109 A1 10/2014 Stewart et al.
2014/0290110 A1 10/2014 Stewart et al.
2014/0360073 A1 12/2014 Stewart et al.
2014/0366420 A1 * 12/2014 Hager ..... F41A 17/063 42/70.11
2015/0068093 A1 3/2015 Milde, Jr. et al.
(Continued)

FOREIGN PATENT DOCUMENTS

CA 2299307 11/1999
CN 1190921 8/1998
(Continued)

*Primary Examiner* — Reginald S Tillman, Jr.
(74) *Attorney, Agent, or Firm* — Davis Wright Tremaine LLP

(57) ABSTRACT

One aspect includes a method of configuring a smart-gun that includes configuring a smart-gun from a locked configuration where the smart-gun is inoperable to fire, to an unlocked configuration where the smart-gun is operable to fire, the configuring in response to authenticating unlock data at the smart-gun; receiving an unlock ping at the smart-gun; maintaining the smart-gun in the unlocked configuration in response to the unlock ping being received; determining by the smart-gun that a second subsequent unlock ping has not been received within a timeout limit; and configuring the smart-gun from the unlocked configuration to the locked configuration in response to the determining that the second subsequent unlock ping has not been received within the timeout limit.

20 Claims, 4 Drawing Sheets

(56) References Cited

U.S. PATENT DOCUMENTS

| | | | | |
|---|---|---|---|---|
| 2015/0184962 | A1* | 7/2015 | Burdine | F41A 17/063 42/70.11 |
| 2015/0199547 | A1 | 7/2015 | Fraccaroli | |
| 2017/0010062 | A1* | 1/2017 | Black | F41A 17/063 |

FOREIGN PATENT DOCUMENTS

| | | |
|---|---|---|
| CN | 201397085 | 2/2010 |
| EP | 1605222 | 12/2005 |
| WO | 2014/163653 | 10/2014 |
| WO | 2015/116021 | 8/2015 |

* cited by examiner

SMART-GUN SYSTEMS AND METHODS

CROSS-REFERENCE TO RELATED APPLICATIONS

This application is a non-provisional of U.S. Provisional Application Ser. No. 62/294,171 filed Feb. 11, 2016, which application is hereby incorporated herein by reference in its entirety and for all purposes.

BACKGROUND

Conventional firearms are unable to distinguish between authorized users and unauthorized users such as unsupervised children or malicious users. Accordingly, when unauthorized users gain control of conventional firearms, such users can potentially harm themselves and others, including authorized users.

In view of the foregoing, a need exists for an improved smart-gun system and method in an effort to overcome the aforementioned obstacles and deficiencies of conventional firearms.

Figure 1:
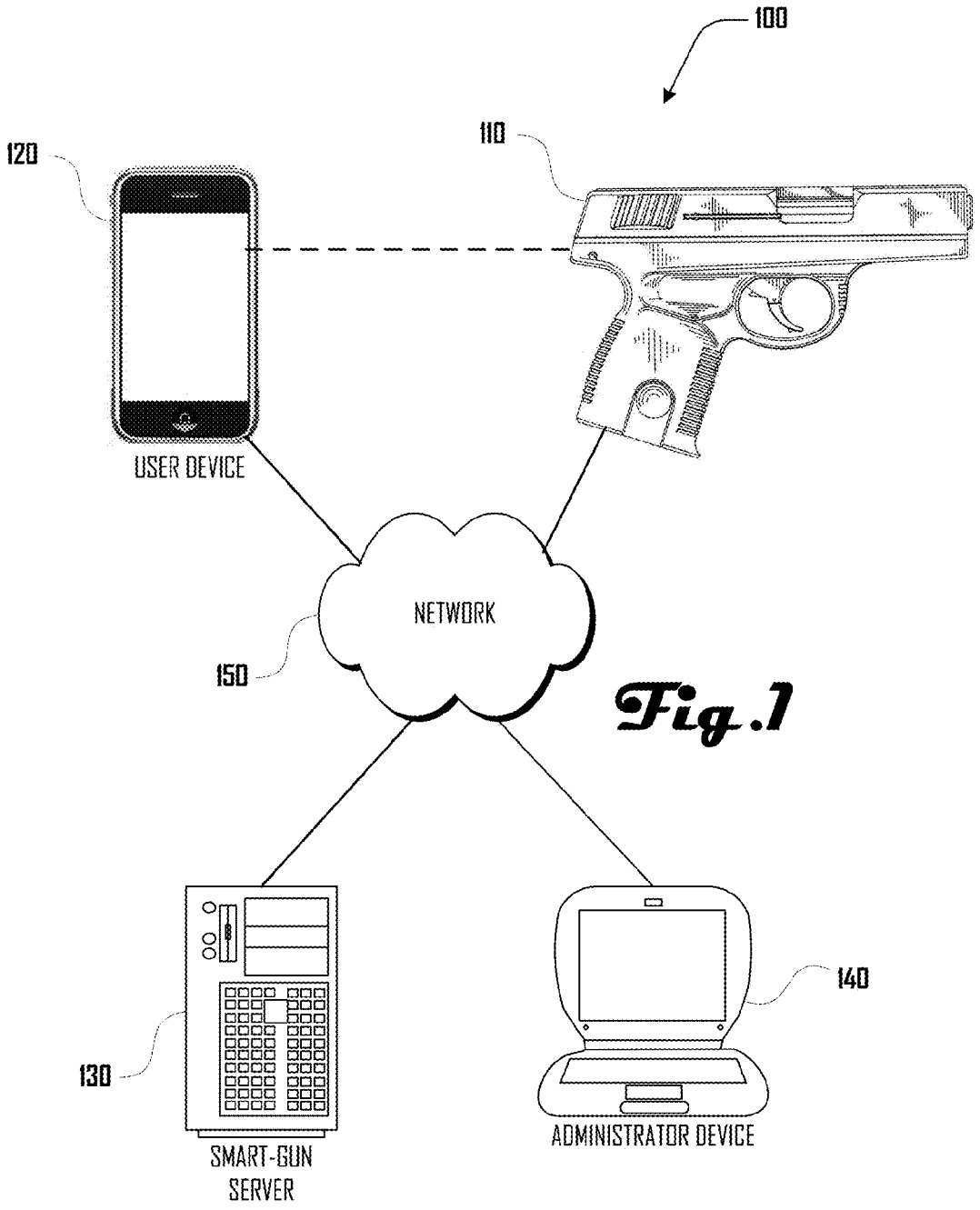
FIG. 1 is an exemplary top-level drawing illustrating an example embodiment of a smart-gun system.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

Turning to FIG. 1, an example smart-gun system 100 is shown as comprising a smart-gun 110, a user device 120, a smart-gun server 130 and an administrator device 140, which are operably connected via a network 150. Additionally, the user device 120 and smart-gun 110 are illustrated as being directly operably connected.

Although a semi-automatic handgun is illustrated as an example smart-gun 110 in accordance with some example embodiments of the present invention, it should be clear that various suitable guns can be implemented as a smart-gun 110. For example, in further embodiments a smart-gun can comprise a rifle, pistol, shotgun, machine gun, submachine gun, paintball gun, pellet gun, or the like. Additionally, any suitable weaponry can be associated with a smart-gun system 100, including a rocket launcher, rocket propelled grenade (RPG) launcher, mortar, cannon, heavy machine gun, Gatling gun, or the like. Such guns or weapons can be handheld, ground-based, mounted on a vehicle, mounted on a drone, or the like.

Although a smartphone is illustrated as a user device 120 and a laptop computer is illustrated as being an administrator device 140, in further embodiments, any suitable device can serve as a user device 120 or administrator device 140. For example, in various embodiments one or both of the user device 120 and administrator device 140 can comprise a smartphone, wearable computer, laptop computer, desktop computer, tablet computer, gaming device, television, home automation system, or the like. Additionally, the smart-gun server 130 can also comprise any suitable server system including cloud and non-cloud based systems.

The network 150 can comprise any suitable network, including one or more local area network (LAN) wide area network (WAN), or the like. The network 150 can comprise one or more Wi-Fi network, cellular network, satellite network, and the like. Such a network 150 can be wireless and/or non-wireless. As discussed herein, the smart-gun 110 and user device 120 can be connected via a suitable network 150 and/or can be directly connected via a Bluetooth network, near field communication (NFC) network, and the like.

Accordingly, the smart-gun 110, user device 120, smart-gun server 130, and administrator device 140 can be configured to communicate via one or more suitable network and/or network protocol. For example, in some embodiments, the smart-gun 110 can be operable to communicate via Bluetooth, Wi-Fi, a cellular network, a satellite network and/or a near-field network.

In further embodiments, the smart-gun 110 can be inoperable to communicate via certain networks or via certain network protocols. For example, in some embodiments, the smart-gun 110 can be limited to only communicating via short range wireless communications such as Bluetooth or near-field communications and can be inoperable for communication via longer-range networks such as Wi-Fi or a cellular network. In such embodiments, the smart-gun 110 can be configured to communicate with devices such as the smart-gun server 130 and/or administrator server 140 via the user device 120, which can serve as a gateway to longer range networks and/or functionalities. Such embodiments can be desirable because the smart-gun 110 can operate with minimal hardware and power consumption, yet still access longer range networks and/or functionalities via the user device 120.

In various embodiments, a smart-gun system 100 can comprise any suitable plurality of any of the smart-gun 110, user device 120, smart-gun server 130, and/or administrator device 140. For example, in some embodiments, there can be a plurality of smart-guns 110, which are each associated with a respective user device 120. In another example, a plurality of smart-guns 110 can be associated with a given user device 120. In a further example, a plurality of user devices 120 can be associated with a given smart-gun 110. In some embodiments, one or more of the user device 120, smart-gun server 130 or administrator server 140 can be absent from a smart-gun system 100.

In embodiments where the smart-gun system 100 comprises a plurality of smart-guns 110 and/or user devices 120, each smart-gun 110 and/or user device 120 can be associated with at least one identifier which may or may not be a unique identifier. For example, in some embodiments, such an identifier can include a serial number (e.g., stored in a memory, firmware, or the like), a Media Access Control (MAC) address, a Mobile Station International Subscriber Directory Number (MSISDN), a Subscriber Identify Module (SIM) card, or the like. Such identifier(s) can be permanently and/or removably associated with the smart-gun 110 and/or user device 120. For example, in some embodiments various types of SIM cards can be associated with a smart-gun 110 and/or user device 120 including Full Sized SIMs, Micro-SIMS, Nano-SIMS and the like. As discussed in more detail herein, one or more smart-gun identifiers can be used to lock or unlock a smart-gun 110.

In various embodiments, a smart-gun 110 can be configured to be selectively locked and/or unlocked. For example, in some embodiments, a smart-gun 110 in a locked configuration can be inoperable to fire, whereas a smart-gun 110 in an unlocked configuration can be operable to fire. Locking and unlocking a smart-gun 110 can use any suitable mechanism to enable or disable the firing capability of the smart-gun 110. In one preferred embodiment, a solenoid can be used to enable or disable action of a firing pin of a smart-gun 110.

In further embodiments, one or more functionalities or a smart-gun 110 can be selectively locked/unlocked or enabled/disabled. For example, such functionalities can include, loading a magazine, unloading a magazine, loading a round into the chamber, movement of the slide, discharging a spent shell, movement of the trigger, actuation of one or more safety, cocking of the hammer, rotation of the cylinder, release of the cylinder, movement of the bolt assembly, functioning of a gas system, actuation of a selector switch, movement of a charging handle, use of sights, and the like.

In some embodiments a smart-gun 110 can be permanently or semi-permanently disabled. For example, in one embodiment, one or more parts of smart-gun 110 can be selectively broken and/or deformed such that the smart-gun 110 is effectively irrevocably broken and un-reparable. Alternatively, one or more parts of smart-gun 110 can be selectively broken and/or deformed such that the smart-gun 110 can be repaired, but with considerable time, work, or difficulty. For example, such a broken part may be only available from a secure source, or may only be replaceable by disassembly of the smart-gun 110.

Such locking, unlocking or disabling of the smart-gun 110 can occur based on various suitable circumstances, triggers, conditions, or the like. In some embodiments, such locking, unlocking or disabling of the smart-gun 110 can occur based on a signal (or lack of a signal) from one or more of the user device 120, smart-gun server 130 or administrator device 140. In one example, a user can use an application on the user device 120 to lock, unlock or disable the smart-gun 110 for use, which can include pushing a button on an application interface, inputting a password, use of voice recognition, fingerprint scanning, retinal scanning, or the like. In another example, the user can "tap" the smart-gun 110 with the user device 120 to lock, unlock or disable the smart-gun 110. In a further example, the user can request and obtain an unlock software token from a token authority which may include communication with one or both of the smart-gun server 130 or administrator device 140. Such authentication can include a two-factor authentication (e.g., an RSA token, or the like).

In further embodiments, the smart-gun 110 can be locked, unlocked or disabled based on time. In one example, a smart-gun 110 can be unlocked and then be automatically locked after a certain period of time has elapsed (e.g., a number of minutes, hours, days, weeks, or the like). In another example, a smart-gun 110 can be automatically locked and unlocked based on a schedule (e.g., unlocked from 5:50 pm until 7:30 am the following day and locked outside of this timeframe). Such a period of time or schedule can be set by a user via the user device 120, an administrator at the administrator device 140, the smart-gun server 130, or the like.

In still further embodiments, the smart-gun 110 can be locked, unlocked or disabled based on location. In one example, the smart-gun 110 can be locked, unlocked or disabled based on being inside or outside of defined physical boundaries, where location of the smart-gun 110 is defined by position of the smart-gun 110 and/or user device 120. Accordingly, one or both of the smart-gun 110 or user device 120 can be provisioned with suitable position sensors, which can include a Global Positioning System (GPS), or the like. Physical boundaries can include the range of a room of a building, the interior of a building, a city block, a metropolitan area, a country, or any other suitable boundary of any desirable size. Such physical boundaries can be set by a user via the user device 120, an administrator at the administrator device 140, the smart-gun server 130, or the like.

In some embodiments, the smart-gun system 100 can comprise one or more field enablement devices that are configured to lock, unlock or disable one or more smart-gun 110. In some examples, such a field enablement device can operate similar to a user device 120 as described herein, or in further embodiments, a field enablement device can lock, unlock or disable one or more smart-gun 110 in ways different from the command and control structure and communication pathways of a user device 120 as described in.

Additionally, in some examples, such a field enablement device can override and/or act in addition to a user device 120 as described herein. For example, in some embodiments, a field enablement device can lock, unlock or disable one or more smart-gun 110 without a user device 120 or overriding a user device 120. Also, in some embodiments, the field enablement device can be configured to prevent, restrict or add one or more functionality of a user device 120. For example, the field enablement device can prevent a user device 120 from unlocking any smart-guns 110, but the user device 120 can retain the functionality of locking or disabling smart-guns 110.

In another embodiment, a field enablement device can be configured to convert a user device 120 or smart-gun 110 into, or to have some or all functionalities of, a field enablement device. For example, a field enablement device can allow a user device 120 or smart-gun 110 to act as a second field enablement device, which in turn can enable one or more further user devices 120 or smart-guns 110 to act as a field enablement device. In another example, a field enablement device can be a master smart-gun 110 that can enable the smart-guns 110 around it.

Such configuration by a field enablement device can occur in various suitable ways, including direct communication with a user device 120 or smart-gun 110, or indirect communication via the network 150 as described herein. A field enablement device can include various suitable devices as described herein, which can be mobile mounted, portable, or the like. For example, the a field enablement device can include or comprise a device such as a smart-gun 110, user device 120, smart-gun server 130, admin device 140, or the like.

Figure 2A:
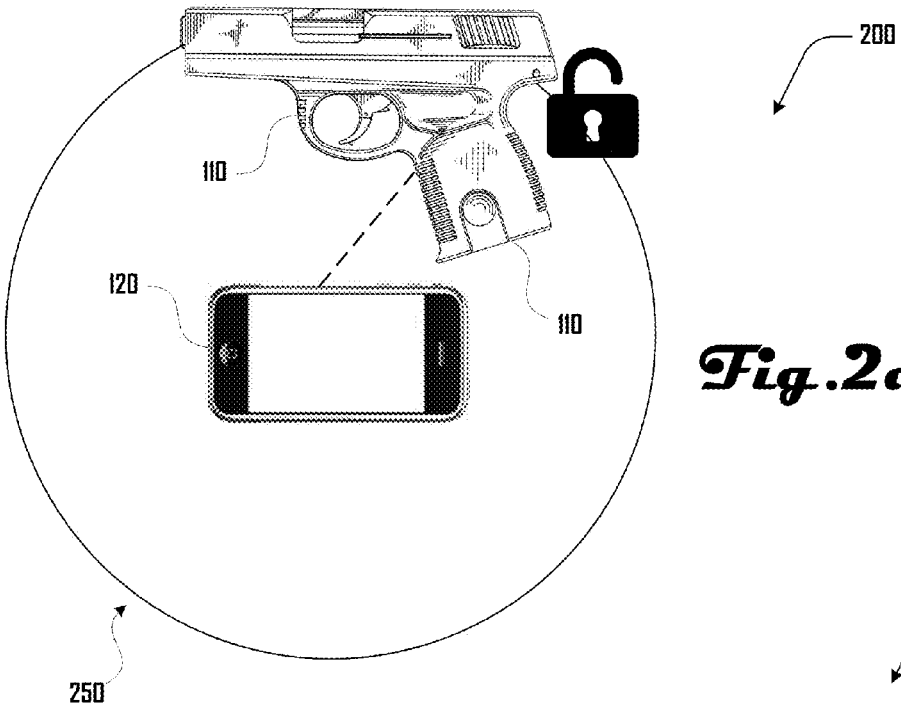
FIGS. 2*a* and 2*b* are exemplary drawings illustrating an embodiment of a smart-gun being unlocked when within range of a user device and locked when out of range of the user device.
Figure 2B:
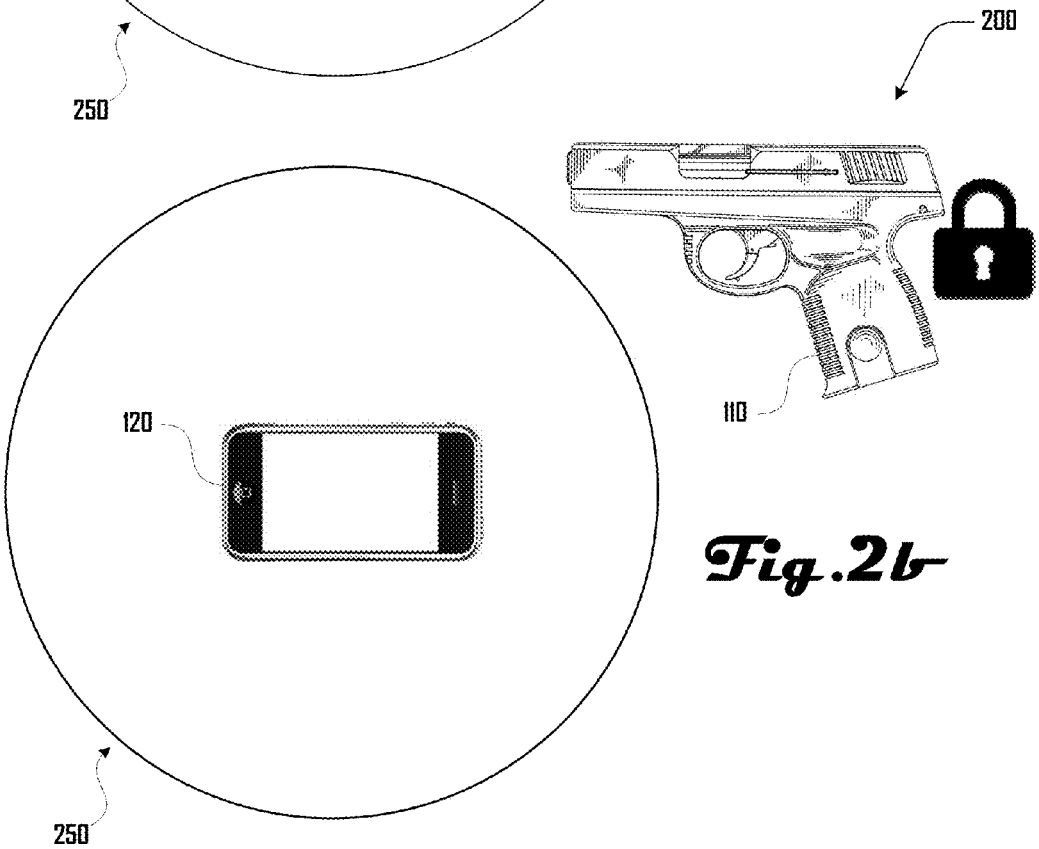

In some embodiments, the smart-gun 110 can be locked, unlocked or disabled based on proximity and/or connectivity to one or more device. For example, turning to FIGS. 2*a* and 2*b* a smart-gun 110 can be paired with user device 120 and the locked, unlocked or disabled status of the smart-gun 110 can change based on a distance or range 250 from the user device 120. As illustrated in FIG. 2*b*, the user device 120 and smart-gun 110 are paired and the smart-gun 110 is within a defined range 250 of the user device 120 and therefore the smart-gun 110 is unlocked. However, as illustrated in FIG. 2, if the smart-gun 110 is outside of the defined range 250 of the user device 120, the smart-gun 110 is locked or disabled. In some embodiments, if the smart-gun 110 comes back within range of the user device 120, the smart-gun 110 may automatically become unlocked again. Alternatively, the smart-gun 110 may remain locked until it is unlocked, even when in range of the user device 120 again, until the smart-gun 110 is unlocked by a user via a suitable method as discussed herein.

A range 250 from the user device 120 can be determined or defined in any suitable way. For example, in some embodiments, GPS or other positioning can be used. In other embodiments, signal strength of a network connection, network connectivity, or the like, can define a range 250. For example, a user device 120 can be paired with a smart-gun 110 via a Bluetooth connection and where the signal strength of the Bluetooth connection drops below a certain level (e.g., drops below a defined decibel (dB) level), the smart-gun 110 can determine that it is out of range 250 and lock or disable itself. In another example, a user device 120 can be paired with a smart-gun 110 via a Bluetooth connection and where the Bluetooth connection is lost or otherwise terminated, the smart-gun 110 can determine that it is out of range 250 and lock or disable itself.

In yet another example, the smart-gun 110 can be paired with a user device via a Bluetooth connection and the user device 120 can periodically send an unlock ping to the smart-gun 110, which can remain unlocked as long as the unlock ping is received by the smart-gun 110. Where the unlock ping is not received by the smart-gun 110 (e.g., due to the Bluetooth connection being lost due to distance between the smart-gun 110 and user device 120), the smart-gun 110 can determine that it is out of range 250 and lock or disable itself.

Figure 3:
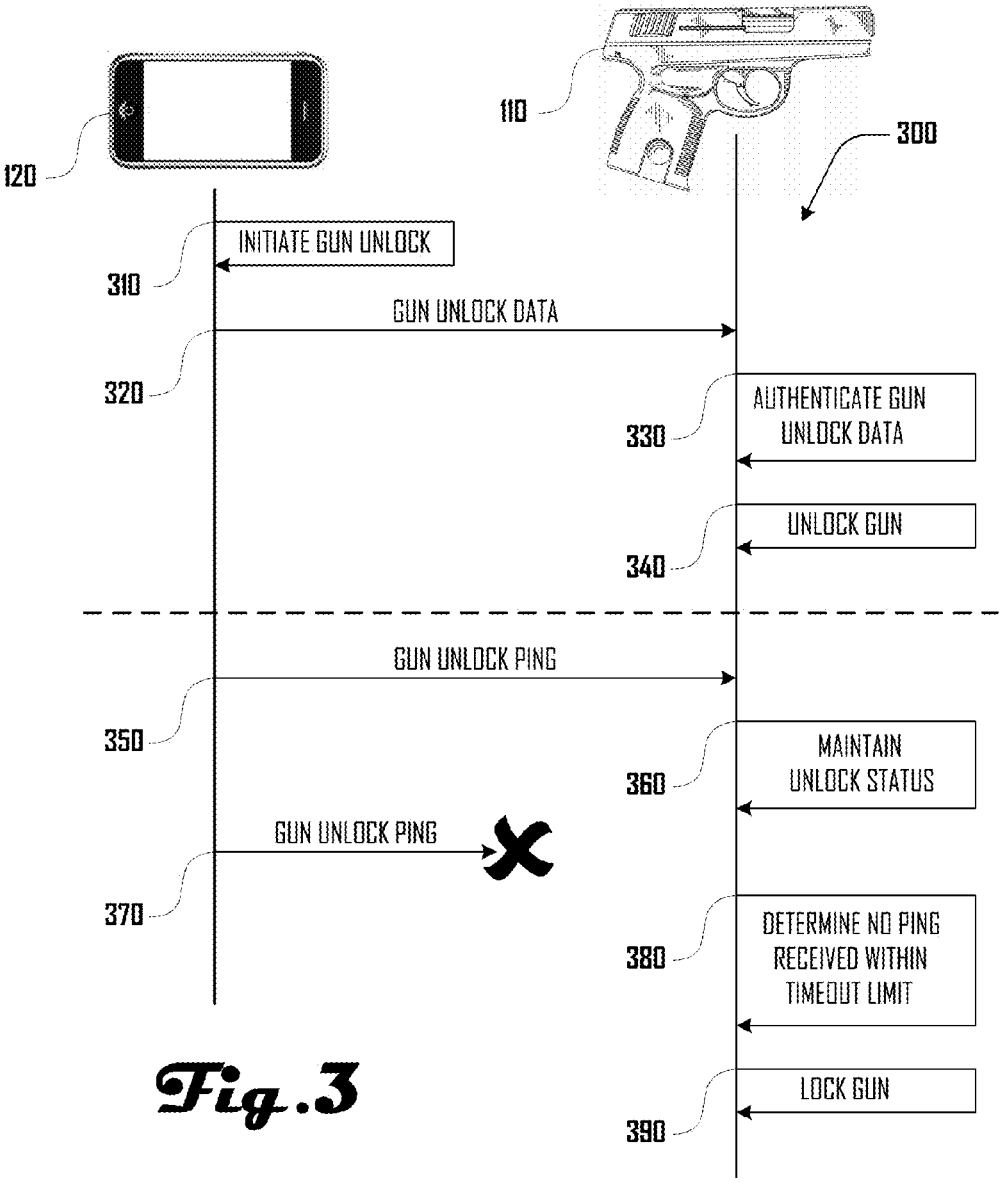
FIG. 3 is an exemplary data flow diagram illustrating example communications between a user device and a smart-gun during unlocking, operation and locking of the smart-gun.

FIG. 3 illustrates a set of example communications between the user device 120 and smart-gun 110 in accordance with one such embodiment. The communications 300 begin where the user device 120 initiates 310 unlocking of the smart-gun 110 and gun unlock data is sent 320 to the smart-gun 110. The gun unlock data is authenticated 330 and the smart-gun is unlocked 340. As discussed herein, such unlocking can include the user inputting a passcode, use of voice recognition, fingerprint scanning, retinal scanning, tapping the smart-gun 110, requesting/obtaining an unlock token, or the like. Authentication 330 can include verifying a received passcode, token, identifier, or the like, that is operable to unlock the smart-gun 110.

A gun unlocking ping can be sent 350 to the smart-gun 110 and the unlocked status of the smart-gun 110 can be maintained. A gun unlock ping can be of any suitable form or type. For example, in some embodiments, the gun unlock ping can comprise a conventional networking ping, message, packet or other conventional networking communication. In a further example, the gun unlock ping can comprise a code, serial number or identifier, which can be fixed or changing. Various suitable types of cryptography can be used to encrypt such a gun unlock ping and cryptography protocols can be negotiated during initial unlocking of the smart-gun 110 or at another suitable time. In some embodiments, the gun unlock ping can be sent in multiple pieces. In some embodiments, the gun unlock ping can be sent among false or decoy pings so that the authentic ping cannot be identified via signal snooping, or the like.

Returning to the communications 300 a further gun unlock ping is sent 370, but is not received by the smart-gun 110. At the smart-gun 110, it is determined 380 that a gun unlock ping has not been received within a timeout limit, and in response, the smart-gun 110 is locked 390. Timeout limits can be any suitable amount of time including time on the order of milliseconds, seconds, minutes, hours, days, or the like. Gun unlock pings can be sent by the user device 120 at any suitable regular or irregular intervals.

Figure 4:
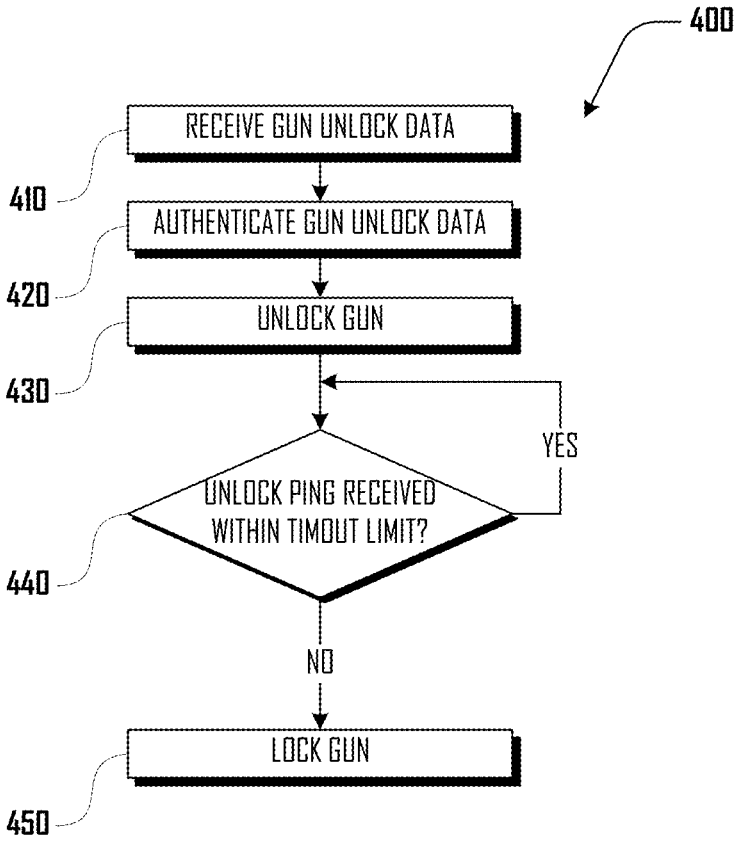
FIG. 4 is a block diagram illustrating a method of unlocking a smart-gun and determining whether it should subsequently be locked.

FIG. 4 illustrates an example method 400 of selectively unlocking and locking a smart-gun 110 in accordance with one embodiment. The method 400 begins where gun unlock data is received 410, the gun unlock data is authenticated 420 and the smart-gun 110 is unlocked 430. At 440, a determination is made whether an unlock ping is received within a timeout limit, and if so, the method 400 cycles back to 440, where the determination is again made whether an unlock ping is received within the timeout limit. However, if at 440, a determination is made that an unlock ping is not received within the timeout limit, then the smart-gun 110 is locked 450.

Locking, unlocking or disabling a smart-gun 110 based on range, distance, proximity, connectivity, or the like can be done in various other suitable ways. For example, where a user device 120 and smart-gun 110 are configured to communicate via a cellular network, the smart-gun 110 can remain unlocked while the user device 120 and smart-gun 110 are connected to the same cell tower or to cell different cell towers that are a certain distance apart. However, in such examples, where the user device 120 and smart-gun 110 are not connected to the same cell tower or connected to different cell towers that are more than a defined distance apart, then the smart-gun 110 can automatically become locked or disabled.

Similarly, in a further example, where the user device 120 and smart-gun 110 are configured to communicate via Wi-Fi, the smart-gun 110 can remain unlocked while the user device 120 and smart-gun 110 are connected to the same Wi-Fi network. However, where the user device 120 and smart-gun 110 are not connected to the same Wi-Fi network, then the smart-gun 110 can automatically become locked or disabled.

In further embodiments, a smart-gun 110 can be configured to be locatable if misplaced, lost, stolen or in other situations where it is desirable to identify the location of the smart-gun 110. For example, in one embodiment, the smart-gun 110 can comprise a location device that includes a mini-SIM card, a small wireless rechargeable battery, and an antenna. The location device could be dormant until the location of the smart-gun 110 needs to be determined, and then a user (via a user device 120, administrator device 140, or the like) could ping the location device and determine its location (e.g., based on position relative to cell towers).

Similarly, such a location device could be associated with key fobs, wallets, purses, pet collars, and the like, which would allow such articles to be located if necessary. In some examples, such a location device could be embedded in various articles or can be disposed in a fob or token that can be attached or otherwise coupled with various articles.

A smart-gun 110 can be powered in various suitable ways. For example, in some embodiments, the smart-gun 110 can comprise a battery that is configured to be wirelessly changed (e.g., via inductive coupling, and the like). In some embodiments, a power source can be removably attached to the body of the smart-gun 110 or can be disposed within the smart-gun 110. In some embodiments, magazines for the smart-gun 110 can comprise a rechargeable power source, which can provide power to the smart-gun 110. In various embodiments, a power source associated with a smart-gun 110 can be configured to be recharged based on movement of a user, cycling of the smart-gun 110 during firing, and the like.

Various embodiments of a smart-gun system 100 (FIG. 1) can be used in beneficial ways to improve safety for firearm users and the public in general. In one example, law enforcement officers can carry smart-guns 110, which can be enabled before the officers start their shift. Such enablement can be performed by an officer's user device 120 and paired with the officer's smart-gun 110. In the event that the smart-gun 110 is lost or taken from the officer, the smart-gun 110 would automatically become locked if the smart-gun 110 was a distance away from the officer (e.g., one meter, or the like).

In another example, a smart-gun owner could enable a smart-gun 110 via a smartphone user device 120 and share the smart-gun 110 with others for use while the owner is present. The owner could set various suitable functionality limitations (e.g., the smart-gun 110 must be tapped by the smartphone user device 120 to eject or load a magazine) and the smart-gun 110 could be configured to automatically become locked if it moved out of range of the user device 120 (e.g., 10 meters, or the like).

In a further example, a gun range can rent or loan smart-guns 110 to patrons. Functionality of each smart-gun 110 could be customized for each user in any suitable way (e.g., the patron can shoot and load four magazines before the smart-gun 110 then becomes locked). Such customized functionality can occur automatically when the smart-gun 110 is checked out by the patron based on a patron user profile (e.g., patrons of different proficiency levels or age can have different sets of functionality permissions). Additionally, such smart-guns 110 could remain locked until checked out, and when checked out and unlocked, could be automatically locked if they were moved a certain proximity from the gun range (e.g., out of range of a Wi-Fi network signal of the gun range).

In another example, law enforcement or military organizations could remotely control large groups of weapons individually and/or collectively. Such control could be via any suitable network, including a satellite network, a cellular network, a Wi-Fi network, or the like. Such control could include unlocking, locking or disabling one or more smart-guns 110 or modifying the functionalities of one or more smart-guns 110.

In various examples, smart-guns 110 can be configured to be safe and/or inert when locked or disabled. In such examples, the smart-gun 110 can be safe, even while loaded, so that unintended users such as unsupervised children would be protected if they came in contact with a locked or disabled smart-gun 110. Additionally, the capability of locking or disabling smart-guns 110 can provide a deterrent for theft of such smart-guns 110 because in various embodiments, smart-guns 110 would be unusable by such unauthorized users.

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives. Additionally, any of the actions discussed herein can be performed automatically without human or user interaction.

What is claimed is:

1. A smart-gun system comprising a plurality of smart-guns and a plurality of user devices defining a plurality of smart-gun and user device pairs, with each pair respectively configured to:

send unlock data, by a first user device of the pair, to a first smart-gun of the pair via wireless communication;

authenticate the unlock data at the first smart-gun;

configure the first smart-gun from a locked configuration where the first smart-gun is inoperable to fire, to an unlocked configuration where the first smart-gun is operable to fire, the configuring in response to the authenticating the unlock data at the first smart-gun and occurring without user interaction at the first smart-gun;

send, by the first user device to the first smart-gun via wireless communication, a first unlock ping;

maintain the first smart-gun in the unlocked configuration in response to the first unlock ping being received at the first smart-gun;

determine by the first smart-gun that a second subsequent unlock ping has not been received within a timeout limit; and configure the first smart-gun from the unlocked configuration to the locked configuration in response to the determining that the second subsequent unlock ping has not been received within the timeout limit and without user interaction at the first smart-gun.

2. The smart-gun system of claim 1, further comprising a smart-gun server and wherein the plurality of user devices are configured to communicate with the smart-gun server via a network, and wherein the plurality of smart-guns are inoperable to communicate via the network and are limited to communication with only one or more of the user devices.

3. The smart-gun system of claim 1, wherein locking the first smart-gun comprises actuating a device to disable the action of a firing pin of the first smart-gun and wherein unlocking the first smart-gun comprises actuating the device to enable the action of the firing pin.

4. The smart-gun system of claim 1, wherein the first smart-gun is configured to receive a disabling signal, and in response to receiving the disabling signal, actuate a device of the first smart-gun to disable the first smart-gun, such that the first smart-gun is inoperable to fire, by breaking a portion of the first smart-gun.

5. The smart-gun system of claim 1, wherein the first smart-gun is further configured to the locked configuration, automatically and without user interaction, based on a defined time schedule during a first time period, and configured to the unlocked configuration, automatically and without user interaction, based on the defined time schedule during a second time period.

6. The smart-gun system of claim 1, wherein the second subsequent unlock ping is sent by the first user device via wireless communication, but not received within the timeout limit by the first smart-gun because the first smart-gun is not within operable communication range of the first user device.

7. The smart-gun system of claim 1, wherein the first smart-gun is further configured to determine that the first user device is outside of a defined range of the first smart-gun, and in response, configure the first smart-gun from the unlocked configuration to the locked configuration automatically and without user interaction.

8. The smart-gun system of claim 1, further comprising a field enablement device configured to unlock the plurality of smart-guns when the field enablement device is proximate to the plurality of smart-guns.

9. The smart-gun system of claim 1, wherein the first user device is operable to lock and unlock the first-smart-gun, but is inoperable to lock or unlock any other smart-gun of the plurality of smart-guns; and wherein the first smart-gun is configured be locked or unlocked by the first user device, but is inoperable to be locked or unlocked by any other user device of the plurality of user devices.

10. A method of configuring a smart-gun, the method comprising:

authenticating unlock data at a first smart-gun, the unlock data being sent from a first user device;

configuring the first smart-gun from a locked configuration where the first smart-gun is inoperable to fire, to an unlocked configuration where the first smart-gun is operable to fire, the configuring in response to the authenticating the unlock data at the first smart-gun;

receiving a first unlock ping at the first smart-gun, the unlock ping being sent from the first user device;

maintaining the first smart-gun in the unlocked configuration in response to the first unlock ping being received;

determining by the first smart-gun that a second subsequent unlock ping has not been received within a timeout limit; and configuring the first smart-gun from the unlocked configuration to the locked configuration in response to the determining that the second subsequent unlock ping has not been received within the timeout limit.

11. The method of claim 10, wherein locking the first smart-gun comprises actuating a device to disable the action of a firing pin of the first smart-gun and wherein unlocking the first smart-gun comprises actuating the device to enable the action of the firing pin.

12. The method of claim 10, further comprising actuating, in response to receiving a disabling signal, a device of the first smart-gun to disable the first smart-gun, such that the first smart-gun is inoperable to fire, by breaking or deforming a portion of the first smart-gun.

13. The method of claim 10, further comprising configuring the first smart-gun to the locked configuration, based at least in part on a defined time schedule during a first time period, and configuring the first smart-gun to the unlocked configuration based at least in part on the defined time schedule during a second time period.

14. The method of claim 10, further comprising determining by the first smart-gun that the first user device is outside of a defined range of the first smart-gun, and in response, configure the first smart-gun from the unlocked configuration to the locked configuration.

15. The method of claim 14, wherein the determining that the first user device is outside of a defined range of the first smart-gun is based at least in part on a signal strength of a network connection between the first user device and first smart-gun.

16. The method of claim 14, further comprising receiving a decoy unlock ping at the first smart-gun sent by the first user device, and determining by the first smart-gun that the decoy unlock ping is a decoy unlock ping and not an unlock ping.

17. A method of configuring a smart-gun, the method comprising:

configuring a first smart-gun from a locked configuration where the first smart-gun is inoperable to fire, to an unlocked configuration where the first smart-gun is operable to fire, the configuring in response to authenticating unlock data at the first smart-gun;

receiving a first unlock ping at the first smart-gun;

maintaining the first smart-gun in the unlocked configuration in response to the first unlock ping being received;

determining by the first smart-gun that a second subsequent unlock ping has not been received within a timeout limit; and configuring the first smart-gun from the unlocked configuration to the locked configuration in response to the determining that the second subsequent unlock ping has not been received within the timeout limit.

18. The method of claim 17, wherein the first unlock ping comprises a wireless communication between the first smart-gun and a user device via a first wireless connection between the first smart-gun and the user device and wherein determining that the second subsequent unlock ping has not been received within the timeout limit includes determining that that the first wireless connection between the first smart-gun and the user device has been broken.

19. The method of claim 18, wherein the determining that that the first wireless connection between the first smart-gun and the user device has been broken includes determining that the first smart-gun is not within a defined range of the first user device.

20. The smart-gun system of claim 1, further comprising:

a smart-gun server; and a field enablement device configured to unlock the plurality of smart-guns when the field enablement device is proximate to the plurality of smart-guns;

wherein the plurality of user devices are configured to communicate with the smart-gun server via a network, and wherein the plurality of smart-guns are inoperable to communicate via the network and are limited to communication with only one or more of the user devices;

wherein locking the first smart-gun comprises actuating a device to disable the action of a firing pin of the first smart-gun and wherein unlocking the first smart-gun comprises actuating the device to enable the action of the firing pin;

wherein the first smart-gun is configured to receive a disabling signal, and in response to receiving the disabling signal, actuate a device of the first smart-gun to disable the first smart-gun, such that the first smart-gun is inoperable to fire, by breaking a portion of the first smart-gun;

wherein the first smart-gun is further configured to the locked configuration, automatically and without user interaction, based on a defined time schedule during a first time period, and configured to the unlocked configuration, automatically and without user interaction, based on the defined time schedule during a second time period;

wherein the second subsequent unlock ping is sent by the first user device via wireless communication, but not received within the timeout limit by the first smart-gun because the first smart-gun is not within operable communication range of the first user device;

wherein the first smart-gun is further configured to determine that the first user device is outside of a defined range of the first smart-gun, and in response, configure the first smart-gun from the unlocked configuration to the locked configuration automatically and without user interaction;

wherein the first user device is operable to lock and unlock the first smart-gun, but is inoperable to lock or unlock any other smart-gun of the plurality of smart-guns; and wherein the first smart-gun is configured be locked or unlocked by the first user device, but is inoperable to be locked or unlocked by any other user device of the plurality of user devices.

* * * * *